US005921790A

United States Patent [19]

Nieminen et al.

[11] Patent Number: 5,921,790

[45] Date of Patent: Jul. 13, 1999

[54] ARRANGEMENT IN CONNECTION WITH A CURRENT TAKE-OFF DEVICE OF A CONTACT RAIL SYSTEM

[75] Inventors: Eero Nieminen, Helsinki; Esko Väisänen, Klaukkala; Risto Jaakkola, Espoo, all of Finland

[73] Assignee: Nordic Aluminium OY, Kirkkonummi, Finland

[21] Appl. No.: 08/972,478

[22] Filed: Nov. 18, 1997

[30] Foreign Application Priority Data

Nov. 28, 1996 [FI] Finland ..... 964751

[51] Int. Cl.[6] ..... H01R 25/00

[52] U.S. Cl. ..... 439/121; 439/395

[58] Field of Search ..... 439/121, 122, 439/395, 404, 405, 116, 117, 118, 119

[56] References Cited

U.S. PATENT DOCUMENTS

| | | | |
|---|---|---|---|
| 4,010,997 | 3/1977 | Bulanchuk | 439/121 |
| 4,163,595 | 8/1979 | Vasseur | 439/121 |
| 4,181,388 | 1/1980 | Donato | 439/122 |
| 4,776,809 | 10/1988 | Hall | 439/121 X |
| 4,872,849 | 10/1989 | Long | 439/395 X |
| 5,820,404 | 10/1998 | Chishima et al. | 439/417 |
| 5,836,782 | 11/1998 | Odley et al. | 439/397 |
| 5,848,911 | 12/1998 | Garcin | 439/395 |

FOREIGN PATENT DOCUMENTS

| | | |
|---|---|---|
| 642 193 | 3/1995 | European Pat. Off. . |
| 675 564 | 10/1995 | European Pat. Off. . |
| 84305 | 7/1991 | Finland . |
| 92635 | 8/1994 | Finland . |
| 31 16731 | 3/1985 | Germany . |
| 44 03 278 | 8/1995 | Germany . |
| 1 551 515 | 8/1979 | United Kingdom . |

*Primary Examiner*—Edgar Burr
*Assistant Examiner*—Minh Chau
*Attorney, Agent, or Firm*—Sughrue, Mion, Zinn, Macpeak & Seas, PLLC

[57] ABSTRACT

An arrangement in connection with a current take-off device of a contact rail system, comprising an adapter portion arranged to be connected to be removable electrically and mechanically to a contact rail, and conductors arranged inside the adapter portion and connected by means of slit edge connectors to contacts providing an electric connection for the adapter portion and the contact rail, by means of which conductors the current is conveyed from the adapter portion to an electrical apparatus to be connected thereto. To ensure an electric contact, at least one wall portion is arranged inside the adapter portion, next to each slit edge connector, which wall portion is arranged to turn the conductor into an inclined position with respect to the plane of a slit of the slit edge connector when the conductor is being pressed into the slit edge connector.

7 Claims, 2 Drawing Sheets

Figure 4:
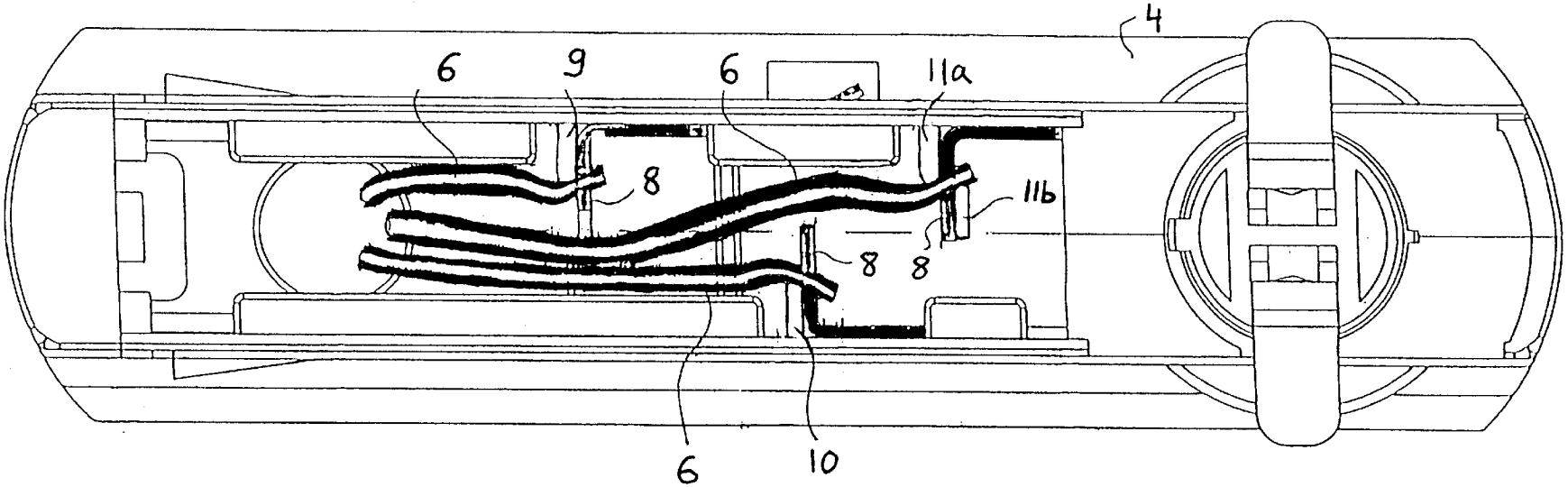

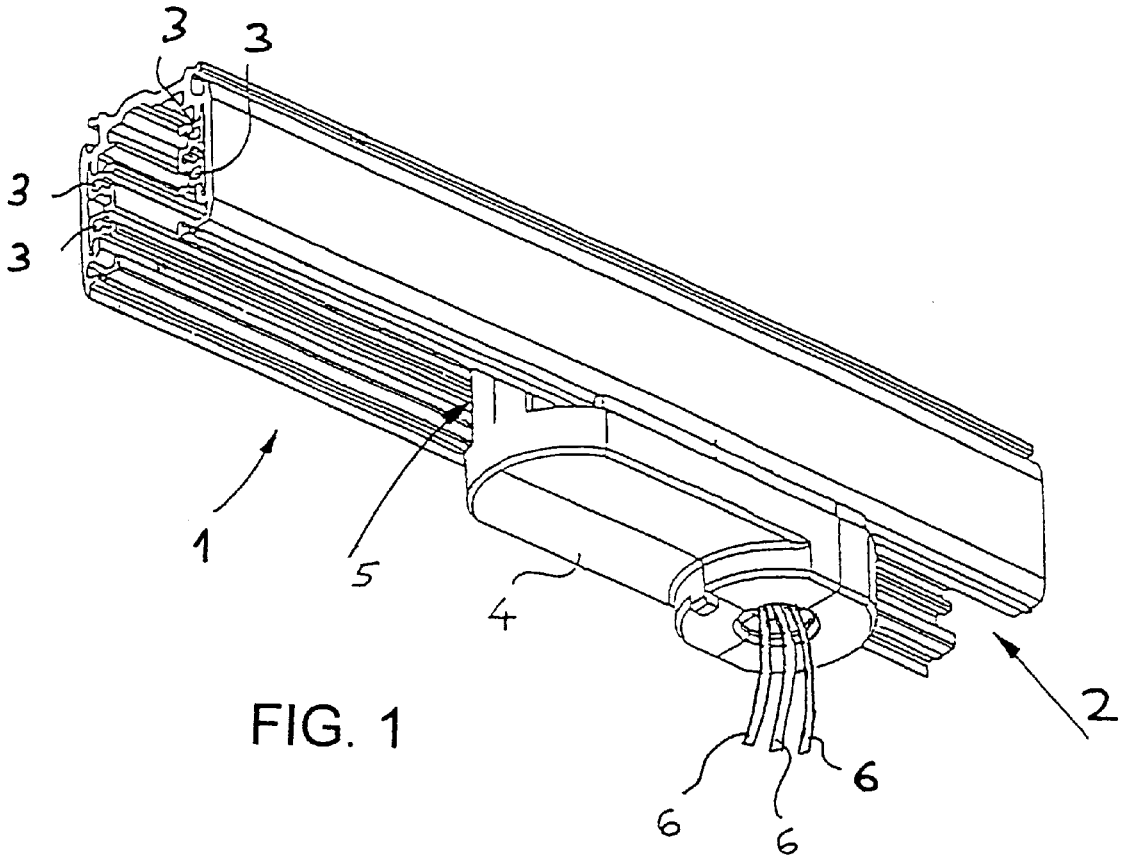
FIG. 1
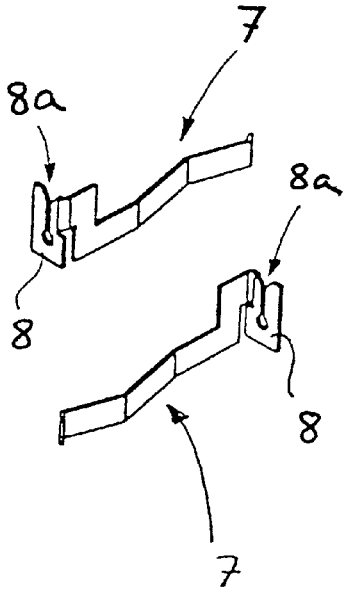
FIG. 2
FIG. 3

ARRANGEMENT IN CONNECTION WITH A CURRENT TAKE-OFF DEVICE OF A CONTACT RAIL SYSTEM

The invention relates to an arrangement in connection with a current take-off device of a contact rail system, comprising an adapter portion arranged to be connected to be removable electrically and mechanically to a contact rail, and conductors arranged inside the adapter portion and connected by means of slit edge connectors to contacts providing an electric connection for the adapter portion and the contact rail, by means of which conductors the current is conveyed from the adapter portion to an electrical apparatus to be connected thereto.

Such contact rail systems are nowadays used generally in various rooms for connecting lights, small devices and other such apparatuses by means of a current take-off device to an electric power supply. Various types of current take-off devices and contact rails have been developed. The solutions disclosed in Finnish Patents 84,305 and 92,635 can be mentioned as examples of prior art.

A drawback of the prior art has been complicated structures, for example, which has raised manufacturing costs. Costs are also raised by the fact that the connections of conductors passing to a light inside an adapter, that is, the connections by which the conductors to the light are connected to the contact elements by means of which the adapter is electrically connected to a contact rail, have previously been made by a screw connection, for example. The number of parts and difficult installation required by screw connections has raised costs, for which reason slit edge connections are increasingly used in the field. In slit edge connections a conductor is pushed into a slit in the contact element, in which case the edges forming the slit are cut through the insulating layer of the conductor and the contact element will be in contact with a portion of the conductor conducting electricity. Such a slit edge connector is described in German Patent 31 61 731 and German Offenlegungsschrift 44 03 278.

However, there have been problems with slit edge connectors caused by that the edges forming the slit are not always cut completely through the insulating layer of the conductor. Because of the above-mentioned problems, it is not always possible to provide an electric connection without time-consuming and costly checks, dismounting of conductor joints, reconnections and other additional steps. As a result of dismounting taking place when conductor joints are checked, even contact elements may often get damaged, in which case the contact elements and in some cases even the whole adapter has to be replaced. The costs are also raised because of this.

It is an object of the invention to provide an arrangement by means of which the drawbacks of prior art can be eliminated. This is achieved with an arrangement of the invention which is characterized in that at least one wall portion is arranged inside the adapter portion, next to each slit edge connector, which wall portion is arranged to turn the conductor into an inclined position with respect to the plane of a slit of the slit edge connector when the conductor is being pressed into the slit edge connector.

A primary advantage of the present invention is that by ensuring that the inclined position of the conductor to be pushed into the slit with respect to the plane of the slit edges, as advantageous cutting characteristics as possible are provided for the edges forming the slit, in which case it is ensured with as small number of steps as possible that an electric connection is made, in practice whenever a conductor is pushed into a slit. A further advantage of the invention is its simplicity, in which case the introduction and use of the invention will be advantageous.

Figure 5:
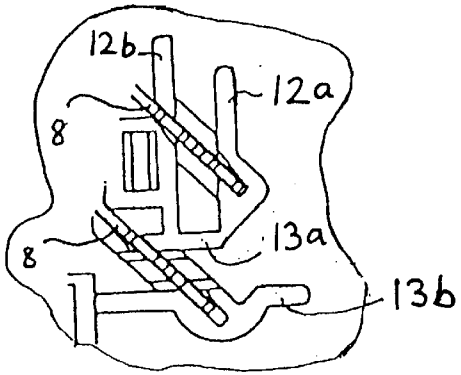

In the following, the invention will be explained in more detail by means one preferred embodiment described in the appended drawing, in which case FIG. 1 is a schematic perspective view of a current take-off device, FIGS. 2 and 3 are schematic perspective views of slit edge connectors to which conductors are connected and by means of which an electric connection is made to a contact rail, FIG. 4 is a sectional view of an adapter to which the arrangement of the invention is arranged, and FIG. 5 is a schematic view of one alternative application of the invention.

In the figures, reference numeral 1 generally refers to a contact rail. A contact rail 1 may be manufactured of an aluminium profile, for example. Reference numeral 2 indicates a contact gap in the longitudinal direction of the contact rail. Reference numerals 3 indicate current conductors in the longitudinal direction of the contact rail, that is, zero conductors and phase conductors.

Reference numeral 4 indicates an encapsulated adapter portion of the current take-off device. The encapsulated adapter portion 4 of the current-take-off device having a projecting contact part 5 placed in the contact gap 2 of the contact rail 1. Reference numeral 6 in FIG. 1 indicates the conductors by which the current is conveyed from the adapter portion to an electrical apparatus to be connected thereto, such as a light.

The current is from the current conductors coming 3 of the contact rail 1 to the conductors 6 by means of contacts 7. A schematic view of the contacts 7 is shown in FIGS. 2 and 3. The contacts 7 are provided with slit edge connectors 8. The conductors 6 are connected to the contacts by pushing the conductor 6 into a slit 8*a* of the slit edge connector 8, in which case the edges forming the slit 8*a* of the slit edge connector are cut through the insulating layer of the conductor and press against the electrically conductive portion of the conductor.

The other ends of the contacts 7 are moved to be in contact with the current conductors of the contact rail 1 in a suitable manner known per se, for example, by means of elements arranged to a rotatable shaft element.

The matters discussed above represent prior art to those skilled in the art, for which reason they are not discussed in more detail in this connection.

According to an essential idea of the invention, at least one wall portion 9, 10, 11*a*, 11*b* is arranged inside the adapter portion 4, next to each slit edge connector 8, which wall portion is arranged to turn the conductor into an inclined position with respect to the plane of the slit 8*a* of the slit edge connector when the slit edge connector 8 is being pressed. The term 'the plane of the slit of the slit edge connector" denotes the plane on which the edges forming the slit are located.

The structure described above is clearly visible in FIG. 4. An advantage of the structure is that by arranging the conductor 6 into an inclined position, better cutting characteristics will be provided for the edges of the slit, by which it is ensured that an electric contact will be attained. By means of the structure of the invention, when installing in the slit, the conductor will always assume an inclined position by forced control, in which case it is ensured that an electric contact is made whenever a conductor is installed.

The wall portion 9, 10, 11*a*, 11*b* of the arrangement as described in he invention can be arranged in various ways next to the slit edge connector. For example, FIG. 4 shows that the wall portion 9 and 10 is arranged on the other side of the slit edge connector. The wall portion can be placed on either side of the slit edge connector. The wall portions 11*a* and 11*b* can also be arranged on both sides of the slit edge connector, as shown in FIG. 4. The idea in both cases is that when the conductor 6 is being pressed into the slit 8*a*, the wall portion 9, 10, 11*a*, 11*b* turns the conductor automatically into an inclined position with respect to the plane of the slit by which it is ensured that an electric contact is provided.

FIG. 5 shows an application where the wall portions 12*a*, 12*b*, 13*a*, 13*b* are formed side by side, substantially parallel with the conductor, in which case a groove formed by the wall portions 12*a*, 12*b*, 13*a*, 13*b* steers the conductor into an inclined position with respect to the plane of the slit of the slit edge connector 8.

The conductor can be pressed into the slit by means of a suitable tool or any such instrument. Some structural part of the adapter portion, such as a cover portion can be mentioned as an example of other instruments.

The embodiment shown above is in no way intended to restrict the invention, but the invention can be modified freely within the scope of the claims. It is therefore evident that the arrangement of the invention or its details need not necessarily be exactly as shown in the figures, but other solutions are also possible. The invention is not, for example, restricted to any particular contact rail system or adapter type, but the invention can, of course, be applied in connection with various contact rail systems and adapters. The example of the figures cannot thus be considered to be a solution restricting the invention, but only an example clarifying the basic idea of the invention.

We claim:

1. An adapter for use with a contact rail system having a contact rail, said adapter being removably mounted to the contact rail so as to provide an electrical connection between the contact rail and an electrical apparatus attached to said adapter, comprising:

a contact for providing an electrical connection between said adapter and the contact rail, said contact including a slit edge connector having a slit;

a conductor arranged inside said adapter and connected to said slit by pressing said conductor into said slit so as to establish an electrical connection between said contact and the electrical apparatus attached to said adapter; and at least one wall portion provided inside said adapter adjacent said slit edge connector so as to turn said conductor into an inclined position with respect to a plane in which said slit lies when said conductor is pressed into said slit.

2. An arrangement according to claim 1, further comprising a plurality of wall portions so that one of said plurality of wall portions is arranged on one side of said slit edge connector and another of said plurality of wall portions is arranged on an opposite side of said slit edge connector.

3. An arrangement according to claim 2, wherein said plurality of wall portions are formed to be substantially transverse with respect to said conductor.

4. An arrangement according to claim 2, wherein said plurality of wall portions are formed to be substantially parallel with said conductor.

5. An arrangement according to claim 1, wherein said at least one wall portion is formed to be substantially transverse with respect to said conductor.

6. An arrangement according to claim 1, wherein said at least one wall portion is formed to be substantially parallel with said conductor.

7. An adapter for use with a contact rail system having a contact rail, said adapter being removably mounted to the contact rail so as to provide an electrical connection between the contact rail and an electrical apparatus attached to said adapter, comprising:

a plurality of contacts for providing electrical connections between said adapter and the contact rail, said plurality of contacts including respective slit edge connectors, each of said slit edge connectors having a slit;

a plurality of conductors arranged inside said adapter such that each of said plurality of conductors is connected to a corresponding slit of said slit edge connectors by pressing each of said conductors into said corresponding slit so as to establish respective electrical connections between said plurality of contacts and the electrical apparatus attached to said adapter; and wall portions provided inside said adapter adjacent each of said slit edge connectors so as to turn each of said conductors into an inclined position with respect to a corresponding plane defined by said corresponding slit when each of said conductors is pressed into said corresponding slit.

* * * * *